United States Patent [19]

Thiele

[11] 4,224,028

[45] Sep. 23, 1980

[54] RETARDATION OF THE PUTREFACTION OF HIDES AND SKINS

[76] Inventor: Geraldine H. Thiele, R.D. #3, Box 280, New Oxford, Pa. 17350

[21] Appl. No.: 961,932

[22] Filed: Nov. 20, 1978

Related U.S. Application Data

[63] Continuation-in-part of Ser. No. 113,362, Feb. 8, 1971, Pat. No. 3,741,204, Ser. No. 123,830, Mar. 12, 1971, Pat. No. 3,767,812, Ser. No. 283,662, Aug. 25, 1972, Pat. No. 3,805,776, Ser. No. 283,663, Aug. 25, 1972, Pat. No. 3,828,772, Ser. No. 369,236, Jun. 12, 1973, Pat. No. 3,924,000, Ser. No. 483,010, Jun. 25, 1974, Pat. No. 3,982,017, Ser. No. 642,114, Dec. 18, 1975, Ser. No. 724,942, Sep. 20, 1976, Ser. No. 724,943, Sep. 20, 1976, abandoned, Ser. No. 755,400, Dec. 29, 1976, Pat. No. 4,097,604, Ser. No. 890,239, Mar. 27, 1978, Ser. No. 918,792, Jun. 26, 1978, Ser. No. 918,795, Jun. 26, 1978, Ser. No. 918,817, Jun. 26, 1978, Ser. No. 927,614, Jul. 24, 1978, and Ser. No. 929,119, Jul. 27, 1978.

[51] Int. Cl.[2] ..... C14C 1/00; C14C 5/00; C14C 11/00

[52] U.S. Cl. ..... 8/94.18; 8/94.22; 8/94.23

[58] Field of Search ..... 8/94.18, 94.22, 94.23

[56] References Cited

U.S. PATENT DOCUMENTS

| | | | |
|---|---|---|---|
| 75,794 | 3/1868 | Robbins | 8/94.18 |
| 3,741,204 | 6/1973 | Thiele | 424/318 |
| 3,767,812 | 10/1973 | Thiele | 424/318 |
| 3,805,776 | 4/1974 | Thiele | 424/318 |
| 3,811,832 | 5/1974 | Briggs | 8/94.23 |
| 3,828,772 | 8/1974 | Thiele | 424/318 |
| 3,832,130 | 8/1974 | Weaver et al. | 8/94.18 |
| 3,924,000 | 12/1975 | Thiele | 424/318 |
| 3,982,017 | 9/1976 | Thiele | 424/318 |
| 4,097,604 | 6/1978 | Thiele | 424/57 |

*Primary Examiner*—Ronald W. Griffin
*Attorney, Agent, or Firm*—Fisher, Christen & Sabol

[57] ABSTRACT

Process for the prevention and/or retardation of the putrefaction of skins, hides, or pelts of freshly slaughtered animals. The skins, hides or pelts, which have not yet been tanned, tawed or otherwise similarly treated, are treated with an effective amount of a solution. The solution contains an effective amount of a non-necrotic sclerosing fatty acid salt, an effective amount of ethanol, a buffering agent and a water carrier. The fatty acid salt is one prepared from an unsaturated fatty acid having one double bond and from an alkali metal, alkaline earth metal, alkali metal compound or alkaline earth metal compound. The pH of the solution is between 9 and 11.

19 Claims, No Drawings

RETARDATION OF THE PUTREFACTION OF HIDES AND SKINS

This application is a continuation-in-part of the following:

(i) application Ser. No. 113,362, Thiele, titled "Method of Treating Bone Fractures and Non-Unions", which was filed on Feb. 8, 1971, and which is now U.S. Pat. No. 3,741,204, issued on June 26, 1973;

(ii) application Ser. No. 123,830, Thiele, titled "Non-Surgical Removal of Abnormal New Bone Proliferation", which was filed on Mar. 12, 1971, and which is now U.S. Pat. No. 3,767,812, issued on Oct. 23, 1973;

(iii) application Ser. No. 283,662, Thiele, titled "Treatment of Non-Surgical Osteolysis of Bone", which was filed on Aug. 25, 1972, and which is now U.S. Pat. No. 3,805,776, issued on Apr. 23, 1974;

(iv) application Ser. No. 283,663, Thiele, titled "Method of Fusing Bones", which was filed on Aug. 25, 1972, and which is now U.S. Pat. No. 3,828,772, issued on Aug. 13, 1974;

(v) application Ser. No. 369,236, Thiele, titled "Injectable Solution", which was filed on June 12, 1973, and which is now U.S. Pat. No. 3,924,000, issued on Dec. 2, 1975;

(vi) application Ser. No. 483,010, Thiele, titled "Injectable Solutions and Processes of Using Such", which was filed on June 25, 1974, and which is now U.S. Pat. No. 3,982,017, issued on Sept. 21, 1976;

(vii) application Ser. No. 642,114, Thiele, titled "Mouthwash and Method for Preventing and Removal Dental Plaque", which was filed on Dec. 18, 1975;

(viii) application Ser. No. 724,942, Thiele, titled "Mouthwash and Method for Preventing and Removing Dental Plaque", which was filed on Sept. 20, 1976;

(ix) application Ser. No. 724,943, Thiele, titled "Injectable Solutions and Processes of Using Such", which was filed on Sept. 20, 1976, now abandoned;

(x) application Ser. No. 755,400 Thiele, titled "Mouthwash and Method for Preventing and Removing Dental Plaque", which was filed on Dec. 29, 1976, and which is now U.S. Pat. No. 4,097,604, issued on June 27, 1978;

(xi) application Ser. No. 890,239, Thiele, titled "Injectable Solutions and Processes of Using Such", which was filed on Mar. 27, 1978.

(xii) application Ser. No. 918,792, Thiele and Yankell, titled "Mouthwash and Methods", which was filed on June 26, 1978;

(xiii) application Ser. No. 918,795, Thiele, titled "Treatment of Sensitive Teeth Syndrome", which was filed on June 26, 1978;

(xiv) application Ser. No. 918,817, Thiele, titled "Mouthwash and Method for Preventing and Removing Dental Plaque", which was filed on June 26, 1978;

(xv) application Ser. No. 927,614, Thiele, titled "Mouthwash and Method For Preventing and Removing Dental Plaque", which was filed on July 24, 1978; and (xvi) application Ser. No. 929,119, Thiele, titled "Mouthwash and Method For Preventing and Removing Dental Plaque", which was filed on July 27, 1978.

BACKGROUND OF THIS INVENTION

1. Field of This Invention

This invention relates to a process for the prevention and/or retardation of the putrefaction of skins, hides and pelts.

2. Prior Art

Leather is made from hide in three steps. First, there is removal of undesirable constituents such as hair, flesh, fat and some interfibrillary matters, leaving a concentrated network of high-protein collagen fibers, greatly softened and interspaced with water. Tanning (i.e., treating the hide with an agent, called tannin) follows which displaces the water and then combines with and coats the collagen fibers. Tanning increases resistance to heat, hydrolysis (decomposition caused by water), and microorganisms. Then there is finishing to obtain proper thickness, moisture, lubrication, and aesthetic appeal. So leather is esentially animal skin protein combined with tannins, small amounts of oils, dyes, finishes, and moisture.

A serious problem in the leather industry is that the rawhides or skins rapidly putrefy, causing serious economic loss and limits the time between skinning and tanning. A means is needed to prevent or retard the rawhides or skins so that the economic loses due to putrefaction between skinning and tanning are lessened.

Early on skins were scrapped, and then sun dried (which prevented rapid decay) but the skins became hard. Animal fats were rubbed into the dried hides to make them soft and pliable. It was found that hair, flesh, fat and the like should be removed. Wood ash and lime have been used to remove hair. Acid deliming and bating with enzymes have been used.

Fish oils have been rubbed into animal skins to make the furs soft and durable.

During preparation and shipping of hides for tanning, protection against excessive heat, humidity, rain and pests is essential. Raw hides are cured or preserved to prevent decay that begins within hours of slaughter. Curing consists of dehydration (of which there are many methods, some relatively costly) without disturbing skin structure.

The purpose of pretanning or beamhouse, operations is to remove undesirable constitutents and to condition the skin for tanning. The first operation in the tannery beamhouse is the soaking of cured hides in water to rehydrate the hide to its original flaccid condition and to remove dirt, salt, and some soluble proteins.

Dehairing is then effected. Liming, in which soaked hides, are treated with lime for one to two weeks to dehair, is still an old standard practice. By addition of such agents as sodium sulfide, dehairing time is reduced to a few hours. For dehairing sheepskins, lime sulfide paste is applied on the flesh side to save the wool, which is pulled in 3 to 12 hours. Liming not only removes hair, fats, and soluble proteins but also swells and conditions fiber structure.

A hide with its hair and flesh removed is known as a pelt (but not to be confused with fur pelts). Deliming is done partly or fully to remove excess alkali and is accomplished by treating with such mild acids as boric, lactic or such acid salts as ammonium chloride or sulfate and sodium bisulfite. The material is then bated to remove interfibrillary proteins and produce a clean white pelt. Bating is essential for special types of hides, such as those for gloving and glace kid leathers. Delimed, bated stock is pickled with a mixture of sulfuric acid and salt in a paddle or drum to prepare it for either long storage or mineral tannage. Fatty skins are degreased with detergent and paraffin solvents, washed and repickled.

There are a number of types of tanning methods. One is oil tanning, which can be combined with other types of tanning. One type of oil tanning produces chamois leather. The special properties of chamois leather result from its open structure. Chamois leather is tanned with aldehydes and peroxides, and coated with polymers from oxidation of fish oil used in the tanning process. Long liming, bating, and mechanical pressing open up and split in fibres; stocking and pounding with fish oil and hanging in heated rooms oxidizes the fish oil. Compounds of copper, manganese, and cobalt accelerate oxidation. Excess oil is washed off with washing soda solution or wetting agents. Though cod oil is favored, sardine, rape and safflower oils are also used. Sulfochlorinate hydrocarbons has been substituted for fish oil when producing white chamois leather. Japanese white leather and Ethiopian red leather are still produced with rape and safflower oils.

Smoking of hides and skins involves a reaction with aldehydes, several of which are used for tanning. Oxidation of oil also produces aldehydes. American Indians still make leather by a process that combines oil and smoke curing.

Bated pelts are tanned with formaldehyde solution for two to four hours and the excess flesh and bacterial matter in the hide is removed by treatment with magnesium acetate or hydrogen peroxide to produce white leathers.

Tawing is another method. Oils or greases are rubbed or worked into the leather. Currying is the tawing of leathers which have been tanned first by other methods.

After tanning, leather is usually dyed. Unless lubricated, leather dries hard. Dyed leathers are treated with oils and fats for lubrication softenss, strength, and waterproofing. Oils and fats are incorporated individually, or in blends, in natural condition, as emulsion, or in solvents, by hand or in a drum.

Vegetable tanned light leathers are oiled by swabbing groundnut (peanut) oil on the grain surface. Sole leather is drummed with a mixture of vegetable oil, mineral oil, and small amounts of sulfated oil, epsom salts, and glucose. The oil keeps loose tanning material from rising to the grain during drying, and produces supple, light-colored leather. Belting leather is treated by hand or in a heated drum with a mixture of cod oil, tallow, wool grease, stearine, and paraffin wax. Currying is similar, incorporating such mixtures as a hot melt.

Light leathers are fat-liquored in a drum with an oil and water emulsion. The uniform penetration of the leather by fat liquor gives a soft, stretchy, loose-grained leather; if the fat liquor is deposited only on the surface, the leather is resilient and tight. Raw oils mixed with emulsifiers give desired properties of softness and pliability to suede. Raw oils mixed with soaps or sulfated oils are commonly used. Such vegetable oils as castor, pam, and groundnut; animal oils as tallow and neat's-foot; marine oils as cod, sperm, and sardine; and mineral oils and fatty alcohols are sulfated with sulfuric acid at low temperatures. The greater the reaction, the greater the penetration and stability of the product. Sulfated oils are favoured for gloving, suede, and soft leathers. Oil may be intorduced into leather along with a solvent and the solvent then evaporated.

Fatty acids and waxes are used for shower proofing or waterproofing of leathers. To avoid the yellowing of aging, especially of white leathers, synthetic oils and sulfated coconut oils are used.

After dying and fat-liquoring, leather contains 45 to 60 percent water and is dried to about 14 percent moisture, chemical and physical reactions taking place. When leather dries to a paler shade, loose tannins, dyes, and oils spread uniformly, penetrate deeply, and are fixed firmly. Uneven drying causes the migration of unfixed tannin dye and oil to the surface.

Mammalian hides and skins are divided into three layers distinct in structure and origin. These are (1) a thin outer layer of epithelial cells called the epidermis; (a thick layer called corium, or dermis; and (3) subcutaneous adipose or flesh layer. In tanning, the epidermis and flesh layers are removed; the corium is tanned into leather. One layer of the corium containing the grain membrane and hyaline layer, together with the arrangement of hair pores, gives a distinct grain surface pattern for each species of animal. The other corium layer is composed of large collagen fibre bundles interwoven at an angle in a three-dimensional network.

Fur is the fine, soft, hairy covering (or coat) of a mammal. Fur usually consists of a layer of relatively short, soft, barbed hairs next to the skin, helping to maintain body temperature, and a top layer formed by longer, stiff, smooth hairs growing up through the underlying layer, serving to shed rain. Various processes are used that make animal furs wearable and enhance their attractiveness. Fur pelts are animal skins with the hair forming the body covering remaining intact. The true furs consist of a soft, dense, undercoat, called ground hair, underhair, or underwool, and a longer protective covering called guard hair or top hair. The pelts of certain animals, lacking either guard or ground hair, are not true furs, although used commercially as furs. Persian lamb, for example, sold as a fur, has only underwool and no guard hairs; monkey fur has guard hairs but no underhair. Mink, with its dense ground hair and long, glossy guard hair, is an example of a true fur.

The skin is composed of a lower layer, or dermis, consisting mainly of connective tissue, toughened during processing to form the leather; and the upper layer, or epidermis, composed mainly of nonliving cells. The epidermis is removing during processing.

Fur skins are dressed to make them suitable for use. The fur dresser aims at the creation of a soft, pliable leather; the removal of superfluous matter from the pelt; and the preservation and enhancement of the natural lusture of the fur. The details of the process vary with the nature and condition of the skin treated, but there are usually at least four distinct stages in the operation. First, there is the preliminary cleaning and softening of the pelt. Then fleshing (removal of fleshy matter from the skin) and stretching is achieved. (To preserve natural oils, furs are greased and rubbed soft, after which the grease is removed in soapsuds and the skins are dried.) Leathering, a tanning process is done that results in the formation of a leather on the skin. Then there is a final cleaning. Separate process in the fur dresser's art are unhairing, or plucking (the removal of guard hairs where necessary); shaving of the leather side to decrease weight, impart suppleness, and improve draping qualities; and sometimes shearing of the ground hair of such furs as fur seal, muskrat, racoon, and beaver to achieve a desired depth.

After the furs are dressed, they may then be dyed.

BROAD DESCRIPTION OF THIS INVENTION

An object of this invention is to provide a process for the prevention and/or retardation of the putrefaction of skins and/or hides. Other objects and advantages of this invention are set out herein or are obvious herefrom to one ordinarily skilled in the art.

The objects and advantages of this invention are achieved by the process of this invention.

This invention involves a process for the prevention and/or retardation of the putrefaction, spoilage or decay of skins, hides, and/or pelts of animals. The process includes treating skins, hides and/or pelts which have not yet been tanned, tawed or otherwise similarly treated to produce leather, with an effective amount of a liquefied composition. The liquefied composition consists essentially of an effective amount of a non-necrotic sclerosing fatty acid salt, an effective amount of ethyl alcohol, a buffering agent and a water carrier. The fatty acid salt is one having been prepared from an unsaturated fatty acid having one double bond and from a alkali metal or an alkaline earth metal or an alkali metal compound or an alkaline earth metal compound. The liquefied composition has a pH between 9 and 11.

Use of this invention means a significant increase in the time before hides, etc., putrefy, thus allowing reduction in the lose of hides, etc., before tanning occurs. The economic problem faced by the leather industry due to lose and/or deteriation of hides, etc., before they can be tanned is a very serious one as untreated hides, etc., particularly which have not been cured in any manner. The liquefied composition used in the process of this invention is an effective antimicrobial agent.

The most preferred liquefied composition contains 5 percent of sodium oleate, 5 percent of ethanol, enough disodium hydrogen phosphate to adjust the pH to about 9.8, and the remainder water.

An advantage of the composition used in this invention is that it is nontoxic, and prolonged usage does not show any toxic effects or tissue damage. The composition is easily applied and is rapid in action. The process of this invention is consistently effective. If very long periods of time occur between slaughter of the animal (with hide removal) and tanning, the treatment can be repeated in order to further prevent and/or retard putrefaction of the hides.

Preferably the liquefied compositions used in the process of this invention are bottled and stored in dark (amber) glass containers. Plastic bottles tend to deactivate the double bond of the unsaturated fatty acid compound and decrease the pH of the liquefied composition. The result is a lowering of the effectiveness of the process of this invention.

The exact mechanism of this invention has not been determined but it is known that the liquefied composition used in this invention has excellent antimicrobial properties. Further, it has been observed that treatment of hides, etc., with the liquefied composition of this invention retards the width-shrinkage with time of hides, etc.

This invention also includes skins, hides and/or pelts or animals which have been treated by the process of this invention to prevent and/or retard the putrefaction of the skins, hides and/or pelts which have not been tanned, tawed or otherwise similarly treated to produce leather. The treatment is done with an effective amount of a liquefied composition which consists essentially of an effective amount of a non-necrotic sclerosing fatty acid salt, an effective amount of ethyl alcohol, a buffering agent and a water carrier. The fatty acid salt is one having been prepared from an unsaturated fatty acid having one double bond and from a alkali metal or an alkaline earth metal or an alkali metal compound or an alkaline earth metal compound. The liquefied composition has a pH between 9 and 11.

Apparently the liquefied composition only coats on the surface and penetrates into the immediate region below the surface of the hide.

DETAILED DESCRIPTION OF THIS INVENTION

Leather is animal hide or skin that has been treated to preserve them and make them suitable for use. Generally, large animals are said to have hides and smaller animals have skins. At times herein the term hides is used to encompass hides, skins and pelts, and the process of this invention encompasses all three. (Generally reference to one also applies to all three.) Pelts, in furs, are the animal skins with the forming the body covering remaining intact. Hides, skins and pelts are composed of water and proteins and, unless preserved, decay rapidly.

Fresh hide is composed of 60 to 70 percent of water by weight, 30 to 35 percent of proteins, about 2 percent of lipids, 0.5 percent of carbohydrates and 1 percent of mineral salts and other substances such as pigments. Of the solid matter, 90 to 95 percent is made up of proteins, both fibrous and nonfibrous. Of the fibrous protein, collagen accounts for over 85 percent of corium; elastin and reticulin are present in small quantities; hair and wool are made up of keratinous (born-producing) fibres. The nonfibrous proteins are albumins (soluble in water), globulins (soluble in salt solutions), and mucins, mucoids, or glycoproteins (soluble in dilute alkalies). (All soluble proteins are removed before tanning. The fibrous protein chains are held in position by chemical bonds giving a cohesive structure that may be broken down by heat and hydrolysis to form glue, or strengthened by tanning to produce leather.)

Hides of animals including mammals, avian species, fish and reptiles can be treated by the process of this invention. Examples of animal hides which can be treated by the process of this invention are cattle, buffalo, bison, sheep, goats, kids, pigs, hogs, horses, camels, crocodiles, snakes, lizards, elephants, zebras, leopards, tigers, cows, bulls, calves, lambs, colts, asses, mules, steers (oxen), boars, peccaries, carpinchos, seals, sea lions, walrus, sharks, whales, blackfish, dolphines, porpoises, alligators, deer, kangaros and ostriches. Examples of pelts which can be treated by the process of this invention are badgers, beavers, lynx, matrens, calves, raccoons, seals, ermines, foxes, rabbits, civets, minks, chinchillas, fishers, kids, lambs, sables, hamsters, quanacos, quanaguitos, weasels, leopards, moles, ocelots, Persina lambs, opossums, ponies, wolverines, skunks, marmots, otters, sea otters, nutrias, wolves and squirrels.

(Rawhide is a hide dressed without tanning.)

Tawing is the process of converting raw hides or raw skins into leather by some process other than soaking in tanning liquor.

Treating the hides, etc., encompasses any effective method of contacting the hides, etc., with the liquefied composition used in this invention. Useful treatment methods include, application or contact by dipping, spraying, application by brush, etc. The liquefied composition of this invention is preferably not used in foam or effervescent form.

The term liquefied composition includes slurries, suspensions, solutions, pastes, emulsions, etc.

All of the components of the liquefied composition must be and are substantially non-toxic in the amounts and under the conditions of use. The useful (sclerosing) fatty acid compounds must be non-necrotic in effect or operation and must not cause the pathologic death of one or more cells, or a portion of any tissue or any organ (of, say, a plant worker) resulting from irreversible damage to the nucleus.

The pH of the liquefied composition should be between about 9 and about 11, preferably between about 9.5 and about 10.5, and most preferably about 9.8. Each non-necrotic (sclerosing) unsaturated fatty acid compound will produce a different pH at a different concentration levels, so non-toxic agents may be added to adjust the pH level, e.g., sodium dihydrogen phosphate, hydrogen disodium phosphate and/or sodium hydroxide, can be used when sodium oleate or another non-necrotic (sclerosing) unsaturated fatty acid compound is used.

It should be noted that aqueous solutions of alkali metal salts of fatty acids in general have an alkaline or neutral pH. For example, sodium oleate has an alkaline pH—this is usually due to hydrolysis in the aqueous solution.

The most preferred unsaturated fatty acids have eighteen carbon atoms with one double bond in the middle of the chain. The most preferred of such fatty acids is oleic acid (i.e., cis-9-oleic acid or cis-9-octadecenoic acid). The next preferred of such fatty acids is elaidic acid (i.e., trans-9-octadecenoic acid).

Examples of other unsaturated fatty acids having one double bond (i.e., monoethenoid fatty acids) having eighteen carbon atoms are: 2-octadecenoic acid (cis and trans forms), $CH_3(CH_2)_{14}CH{=}CHCOOH$;

3-octadecenoic acid, $CH_3(CH_2)_{13}CH{=}CHCH_2COOH$; 4-octadecenoic acid, $CH_3(CH_2)_{12}CH{=}CH(CH_2)_2COOH$; 5-octadecenoic acid, $CH_3(CH_2)_{11}CH{=}CH(CH_2)_3COOH$; 6-octadecenoic acid (cis and trans forms), $CH_3(CH_2)_{10}CH{=}CH(CH_2)_4COOH$; 7-octadecenoic acid (cis and trans forms), $CH_3(CH_2)_9CH{=}CH(CH_2)_5COOH$; 8-octadecenoic acid (cis and trans forms); 10-octadecenoic acid (cis and trans form), $CH_3(CH_2)_6CH{=}CH(CH_2)_8COOH$; 11-octadecenoic acid (cis and trans form), $CH_3(CH_2)_5CH{=}CH(CH_2)_9COOH$; 12-octadecenoic acid (cis and trans form), $CH_3(CH_2)_4CH{=}CH(CH_2)_{10}COOH$; 15-octadecenoic acid (trans form), $CH_3CH_2CH{=}CH(CH_2)_{13}COOH$: 16-octadecenoic acid (trans form), $CH_3CH{=}CH(CH_2)_{13}CH_2COOH$; and 17-octadecenoic acid, $CH_2{=}CH(CH_2)_{14}CH_2COOH$. (It is believed that the fatty acids having the unsaturation at one end of the hydrocarbon chain, or not in the center thereof, have some undesirable properties and effects in the process of this invention—such compounds are useful, but are certainly much less preferred in result.)

Examples of other useful monoethenoid fatty acids are:

2-tridecenoic acid; 11-tridecenoic acid; 12-tridecenoic acid;

2-dodecenoic acid; 5-dodecenoic acid; 6-dodecenoic acid;

7-dodecenoic acid; 9-dodecenoic acid; 10-dodecenoic acid;

11-dodecenoic acid; 9-eicosenoic acid, $CH_3(CH_2)_9CH{=}CH(CH_2)_7COOH$;

11-eicosenoic acid; 14-eicosenoic acid; 2-undecenoic acid;

6-undecenoic acid; 9-undecenoic acid; 10-undecenoic acid;

2-decenoic acid; 3-decenoic acid; 4-decenoic acid; 8-decenoic acid; 9-decenoic acid; acrylic acid, $CH_2{=}CHCOOH$; $\beta$-methylacrylic acid (cis and trans forms), $CH_3CH{=}CHCOOH$; $\alpha$-methylacrylic acid, $CH_2{=}C(CH_3)COOH$; vinyl acetic acid, $CH_2{=}CHCH_2COOH$;

$\beta,\beta$-dimethylacrylic acid, $(CH_3)_2C{=}CHCOOH$; $\beta$-pentenoic acid, $CH_3CH{=}CHCH_2COOH$; allylacetic acid, $CH_2{=}CHCH_2CH_2COOH$; angelic acid;

$CH_3CH{=}C(CH_3)COOH$ (cis form); tiglic acid, $CH_3CH{=}C(CH_3)COOH$ (trans form); 2-heptadecenoic acid, $CH_3(CH_2)_{12}CH_2CH{=}CHCOOH$; 9-heptadecenoic acid (cis and trans forms), $CH_3(CH_2)_6CH{=}CH(CH_2)_7COOH$; 2-hexadecenoic acid, $CH_3(CH_2)_{12}CH{=}CHCOOH$; 9-hexadecenoic acid (cis form);

2-tetradecenoic acid; 4-tetradecenoic acid; 5-tetradecenoic acid;

8-tetradecenoic acid; 9-tetradecenoic acid; 2-nonenoic acid; 3-nonenoic acid; 8-nonenoic acid; 2-octenoic acid 3-octenoic acid;

7-octenoic acid; 2-heptenoic acid; 3-heptenoic acid; 4-heptenoic acid; 5-hetpenoic acid; 6-heptenoic acid; 2-hexenoic acid;

3-hexenoic acid; 4-hexenoic acid; 5-hexenoic acid; 15-tetracosenoic acid; 17-hexacosenic acid and 21-triacentenoic acid.

Examples of fatty acids having a triple bond are: 2-nonynoic acid, $CH_3(CH_2)_5C{=}CCOOH$; 3-nonynoic acid; 4-nonynoic acid; 5-nonynoic acid; 6-nonynoic acid; 7-nonynoic acid; and 8-nonynoic acid.

Examples of diethenoid fatty acids having eighteen carbon atoms are: 6:8-octadecadienoic acid, $CH_3(CH_2)_8CH{=}CHCH{=}CH(CH_2)_4COOH$;

8:10-octadecadienoic acid, (8-trans and 10-trans forms);

8:11-octadecadienoic acid, (8-cis and 11-cis forms);

9:11-octadecadienoic acid, (9-cis, 11-cis and 11-trans forms);

5:12-octadecadienoic acid, (5-cis, 5-trans, 12-trans and 12-cis forms); 9:12-octadecadienoic acid, (9-cis, 9-trans, 12-trans and 12-cis forms); 10:12-octadecadienoic acid, (10-cis, 10-trans, 12-cis and 12-trans forms); 10:13-octadecadienoic acid, (10-cis and 13-cis forms); and 11:14-octadecadienoic acid, (11-cis and 14-cis forms).

Examples of other useful diethenoid acids are:

$\beta$-vinylacrylic acid, $CH_2{=}CHCH{=}CHCOOH$; sorbic acid, $CH_3CH{=}CHCH{=}CHCOOH$; and geranic acid, $(CH_3)_2C{=}CH(CH_2)_2C(CH_3){=}CHCOOH$.

Examples of tetra-triethenoid fatty acid having eighteen carbon atoms are: 9:11:13:15-octadecatetrainoic acid, $CH_3CH_2(CH_2{=}CH_2)_4(CH_2)_7COOH$; 6:9:12:15-octadecatetraenoic acid;

5:9:12-octadecatrienoic acid (5-trans, 9-cis and 12-cis forms);

$CH_3(CH_2)_4CH{=}CHCH_2CH{=}CH(CH_2)_2CH{=}CH(CH_2)_2CH{=}CH(CH_2)_3COOH$; 6:9:12-octadecatrienoic acid; 6:10:14-octadecatrienoic acid; 8:10:12-octadecatrienoic acid (8-cis, 10-trans and 12-cis forms); 9:11:13-octadecatrienoic acid (9-cis, 11-trans, and 13-trans forms); 9:12:15-octadecatrienoic acid (9-cis, 9-trans, 12-cis, 12-trans, 15-cis and 15-trans forms); and 10:12:14-octadecatrienoic acid (10-trans, 12-trans and 14-trans forms). An example of another useful triethenoid fatty acid is dehydrogeranic acid, $(CH_3)_2C{=}CHCH{=}CHC(CH_3){=}CHCOOH$.

Examples of fatty acids having four double bonds are clupandoic acid, arachidonic acid, α-parinaric acid and β-parinaric acid.

The useful unsaturated fatty acids can contain between 1 and 50 carbon atoms, preferably between 14 and 22 carbon atoms and most preferably by a wide margin have 18 carbon atoms.

Examples of useful unsaturated fatty acids are oleic acid, licanic acid, eleostearic acid and clupanodonic acid. The useful unsaturated fatty acids can be those containing one double bond, e.g., oleic acid, two double bonds, e.g., linoleic acid, three double bonds, e.g., eleostearic acid, etc.

Within the scope of this invention, saturated fatty acid compounds are not useful. The mechanism requires fatty acid moiety unsaturation. Compositions containing mixtures of saturated and unsaturated fatty acid compounds, e.g., sodium morrhuate, should not be used due to the presence of a substantial amount of saturated fatty acid compounds. Sodium morrhuate is a mixture of the sodium salts of unsaturated and saturated fatty acids of cod liver oil.

Fatty acids which contain one or more hydroxyl groups (not containing the acid portion), e.g., dihydroxystearic acid and ricinoleic acid, are not useful within the scope of this invention. For example, the negative hydroxyl group in ricinoleic acid does not produce the necessary (cell) differentiation—this applies to all negative substituents on the main carbon chain. A high ammonia content is undesirable. These factors, plus degree of effectiveness, etc., are why the fatty acid compound should not be a substituted one. The fatty acid must not be cyclic. The fatty acid is preferably not branch chained. The fatty acid should be straight chained, with unsaturation at the center of the carbon chain.

The fatty acid compounds can be soaps such as the reaction product of fatty acids and organic bases—but such are not preferred compounds. The fatty acid compounds can be esterified fatty acids. The fatty compounds are most preferably a fatty acid salt. The fatty acid salts can be those prepared from metals such as, aluminum and alkaline earth metals, e.g., calcium, but are preferably those prepared by alkali metals, e.g., sodium (preferred), lithium, potassium, caesium and rubidium. (Ionic fatty acid compounds of sodium, such as, sodium oleate, are preferred even though the potassium salts are usually more soluble.) The metals can be used in the form of hydroxides, carbonates, etc. The fatty acid salts can be prepared from non-metallic inorganic bases, but such is not a preferred category of compounds.

The most preferred compound is sodium oelate.

Examples of useful compounds of oleic acid are: the methyl ester of cis-9-octadecenoic acid; ethyl ester of cis-9-octadecenoic acid; propyl ester of cis-9-octadecenoic acid; isopropyl ester of cis-9-octadecenoic acid; butyl ester of cis-9-octadecenoic acid; isobutyl ester of cis-9-octadecenoic acid; tert.-butyl ester of cis-9-octadecenoic acid; 3-methylbutyl ester of cis-9-octadecenoic acid; 2-methyl-2-butyl ester of cis-9-octadecenoic acid; phenyl ester of cis-9-octadecenoic acid; m-tolyl ester of cis-9-octadecenoic acid; p-phenylphenacyl ester of cis-9-octadecenoic acid; and the amide ester of cis-9-octadecenoic acid.

Examples of useful compounds of elaidic acid are: the methyl ester of trans-9-octadecenoic acid; the ethyl ester of trans-9-octadecenoic acid; and the amide ester of trans-9-octadecenoic acid.

Examples of useful octadecenoic acid compounds are: the methyl ester of trans-2-octadecenoic acid; the ethyl ester of trans-2-octadecenoic acid; the amide ester of trans-2-octadecenoic acid; the methyl ester of trans-3-octadecenoic acid; the methyl ester of cis-6-octadecenoic acid; the p-bromophenacyl ester of cis-6-octadecenoic acid; the amide of cis-6-octadecenoic acid; the triglyceride of cis-6-octadecenoic acid; the ethyl ester of trans-10-octadecenoic acid; the amide ester of trans-10-octadecenoic acid; the p-bromophenacyl ester of cis-11-octadecenoic acid; the methyl ester of trans-11-octadecenoic acid; the ethyl ester of cis-12-octadecenoic acid; and the methyl ester of trans-16-octadecenoic acid.

Examples of other useful monoethenoid fatty acid compounds are: the lithium salt of 9-heptadecenoic acid; the amide of 2-heptadecenoic acid; the methyl ester of 9-heptadecenoic acid; the ethyl ester of 9-heptadecenoic acid; the ethyl ester of 2-hexadecenoic acid; the methyl ester of 9-hexadecenoic acid; the ethyl ester of 9-hexadecenoic acid; the ethyl ester of 2-tetradecenoic acid; the methyl ester of 4-tetradecenoic acid; the ethyl ester of 4-tetradecenoic acid; the methyl ester of 9-tetradecenoic acid; the amide ester of 2-tridecenoic acid; the methyl ester of 12-tridecenoic acid; the ethyl ester of 12-tridecenoic acid; the amide of 7-dodecenoic acid; the ethyl ester of 11-dodecenoic acid; the methyl ester of 11-dodecenoic acid; the amide of 9-eicosenoic acid; the ethyl ester of 9-eicosenoic acid; the methyl ester of 11-eicosenaic acid; the amide of 2-undecenoic acid; the amide of 6-undecenoic acid; the ethyl ester of 9-undecenoic acid; the copper salt of 10-undecenoic acid; the ethyl ester of 10-undecenoic acid; the amide of 10-undecenoic acid; the amide of 2-decenoic acid; the methyl ester of 8-decenoic acid; the ethyl ester of 2-nonenoic acid; the ethyl ester of 8-nonenoic acid; the ethyl ester of 7-octenoic acid; the methyl ester of 7-octenoic acid; the amide of 2-octenoic acid; the methyl ester of 4-heptenoic acid; the methyl ester of 2-hexenoic acid; the ethyl ester of 2-hexenoic acid; the amide of 3-hexenoic acid; the methyl ester of 5-hexenoic acid; the ethyl ester of 2-pentenoic acid; and the amide of 15-tetracosenoic acid.

Examples of useful diethenoid fatty acid compounds having eighteen carbon atoms are: the methyl ester of 6:8-octadecadienoic acid; the methyl ester of 9:11-octadecadienoic acid; the ethyl ester of 9:11-octadecadienoic acid; the sodium salt of 9:12-octadecadienoic acid; the methyl ester of 9:12-octadecadienoic acid; the ethyl ester of 9:12-octadecadienoic acid; the amide of 9:12-octadecadienoic acid; the benzyl amide of 9:12-octadecadienoic aicd; and the methyl ester of 10:12-octadecadienoic acid.

Examples of useful triethenoid fatty acid compounds having eighteen carbon atoms are: the methyl ester of 6:10:14-octadecatrienoic acid; the methyl ester of 9:11:13-octadecatrienoic acid; the ethyl ester of 9:11:13-octadecatrienoic acid; the methyl ester of 9:12:15-octadecatrienoic acid; the ethyl ester of 9:12:15-octadecatrienoic acid; and the methyl ester of 10:12:14-octadecatrienoic acid.

Examples of useful triple bond fatty acid compounds are: the methyl ester of 2-nonynoic acid; the methyl ester of 4-nonynoic acid; the methyl ester of 5-nonynoic acid; the methyl ester of 6-nonynoic acid; the methyl ester of 7-nonynoic acid; the methyl ester of 8-nonynoic acid; the amide of 2-nonynoic acid; the amide of 3-nonynoic acid; the amide of 4-nonynoic acid; the amide of 5-nonynoic acid; the methyl ester of 6-nonynoic acid; the amide of 7-nonynoic acid; and the amide of 8-nonynoic acid.

Most unsaturated fatty acids are found as the less stable cis isomers rather than the more stable trans isomer. The trans isomers have a double bond that is not in a readily accessable position (the two carbon chain portions protrude in opposite directions), and do not give anywhere as good as results. For this reason, elaidic acid (the trans isomer of the cis isomer, oleic acid) does not give anywhere as good results as does oleic acid.

Fatty acids (cis form) that have two or more double bonds are too reactive to perform in the preferred manner. An example of such is linoleic acid, which is too reactive, but is a cis form fatty acid, has two double bonds (somewhat centrally located) and has 18 carbon atoms.

Oleic acid which is $CH_3(CH_2)_7CH{=}CH(CH_2)_7COOH$, has a melting point of 13° C. Vaccenic acid, which is $CH_3(CH_2)_5CH{=}CH(CH_2)_9COOH$, has a melting point of 44° C. This illustrates another reason to have the double bond near the center of the carbon chain—generally such produces a lower melting point, which is important as a liquid fatty acid (salt) is then available over the normal range of usage of the liquefied composition.

The purity of the unsaturated fatty acid salt is important. A composition containing a high percentage of saturated fatty acid moieties will not be very effective. The preferred sodium oleate is particularly effective, while quite innoculous in a toxic and necrotic sense to human tissue.

The liquefied composition should contain between about 3.5 and about 9 percent by weight of the fatty acid salt and usually contains between 4 and 6 percent by weight of the fatty acid salt.

Examples of the liquid carrier for the non-necrotic fatty acid compounds are water (preferred), monoglycerides, diglycerides, etc. A mixture of water and ethanol is the most preferred liquid carrier; a salt (NaCl) can be added to make an isotonic aqueous solution as the liquid carrier.

The liquefied composition preferably contains a buffering agent, such as, sodium phosphate such as secondary sodium phosphate, sodium carbonate, or the salt of a weak organic acid with a strong base of which sodium citrate is an example. Examples of useful buffers are disodium hydrogen phosphate and sodium dihydrogen phosphate (preferred).

A buffer solution exerts control over large pH changes. The buffer capacity is directly proportional to the concentration of the buffer components. It is desirable to keep a high concentration of buffer components so that the pH does not shift during usage of the composition. To achieve this, the sodium oleate (or the like) should be present in a relatively high concentration so that the buffer components are present in a relatively high concentration.

In the preferred compositions using sodium oleate, the ethanol and phosphate buffer are pH level are believed to aid and complement the action of the sodium oleate in a slightly synergistic manner (and may provide the key to the extreme effectiveness of the most preferred composition).

An effective amount of ethanol, for example, ranges between 0.5 to 1 and 10 percent of ethanol. Higher levels of ethanol, such as up to 15 to 25 percent, can be used, but preferably no more than 10 percent of ethanol is used. (A somewhat rapid pH drift can occur if more than 10 percent of ethanol is used.)

Ethanol is a solubilizing agent for the sodium oleate, but the ethanol appears to also have a promoting effect or the like, on the sodium oleate activity. Other solubilizing agents could be used, but the total effectiveness would apparently not be anywhere near as great as when ethanol is used.

Preferably the liquefied composition comprises aqueous solution containing 4 to 6 percent of sodium oleate, 1 to 5 percent of ethanol, enough buffer to adjust the pH to 9.5 to 10.5, and the remainder distilled water. Preferably a phosphate buffer is used.

The most preferred liquefied composition comprises an aqueous solution containing 5 percent of sodium oleate, 5 percent of ethyl alcohol, enough sodium dihydrogen phosphate to adjust the pH to 9.8, and the remainder sterile distilled water.

If desired, in preparing the most preferred liquefied composition the pH can be raised to about 10 by the use of sodium hydroxide before the sodium oleate is added. Then the pH is raised back up to 9.8 by the addition of sodium dihydrogen phosphate, for example.

The composition used in the process of this invention can contain compatible, noninterfering additives. Any foam-causing agent (outside of the crucial basic ingredients) should be avoided for they tend to keep the liquefied composition away from the hide surface. Suitable preservations (for the liquefied composition) can be added in an amount not to exceed 0.5 percent by weight. No additives should be used which hinder the effectiveness of the composition of this invention.

The liquefied composition of this invention can be used in the form of a paste, gel, emulsion, or like by the addition of (an effective amount of) thickener to the liquefied composition. The thickener can be any suitable carrier or base material which forms a paste or the like. Useful thickeners are; methylcellulose; modified starches (5 to 40 percent by weight based on the total gel weight); polyvinyl alcohol (up to 7 percent by weight based on the total gel weight); gelatin (5 to 30 percent by weight based on the total gel weight); Carbowax; hydroxymethyl cellulose or hydroxyethyl cellulose or hydroxypropyl cellulose or methyl cellulose (2 to 20 percent by weight based on the total gel weight); glycerin (preferred); metallic salts of fatty acids (15 percent and above produces a gel); fatty acid esters (e.g., propylene glycol ethers of oleic acids); a water-miscible base made from propylene glycol, stearic acid, diglycol stearate and triethanolamine; glycerin and polyethylene glycol; water-dispersible glycol; water miscible base compound of propylene glycol, stearic acid, sorbitol, water and polyoxyethylene sorbitan monopalmitate; polyethylene glycols and propylene glycol cetyl alcohol, stearyl alcohol, spermacetic; polyoxyl 40 stearate; polyoxyl 8 stearate, water and glycerin; glycerin, cetyl alcohol, mineral oil, an ethoxylated fatty alcohol, water methylparaben and polyparaben. Useful thickeners which form thixotropic gels can be: sodium carboxymethylcellulose (0.5 to 25 percent by weight based on the total gel wieght); and polyvinyl propylene (Pasdone C, made by GAF) (1 to 30 percent by weight based on the total gel weight. To form thixotropic gels, which art knows that certain concentrates of the gel base having a particular viscosity property or molecular weight need be used.

In general, the thickener, should be non-drying and water-miscible or water-soluble. The thickener can be an emulsifier. The thickener should be odorless, non-irritating and non-toxic. The thickener can be colorless or colored.

One advantage of the use of a thickener is that such helps minimizes the stability problems by suspending the chemical action. The thickener increases the shelf life of, for example, sodium oleate by slowing down the hydrolysis thereof.

Unless otherwise stated or indicated, in the following examples and throughout this specification, all percentages, parts and proportions are expressed on a weight basis.

The following example further illustrates, but does not limit this invention.

EXAMPLE

A liquefied composition containing 2.5 weight percent of sodium oleate, 5 weight percent of ethanol, enough sodium dihydrogen phosphate to obtain a pH of 9.8 and the remainder sterile distilled water (q.s.). An identical liquefied composition, but containing 5 weight percent of sodium oleate, and another identified liquefied composition, but containing 10 weight percent of sodium oleate, were prepared. Each of the liquefied compositions were placed in glass bottles.

The untreated, scrapped hide of a freshly slaughtered cow was cut into 4 equal parts. The first part of the hide was the control and was untreated. The second part of the hide was treated with the liquefied composition containing 2.5 weight percent of sodium oleate. The third part of the hide was treated with the liquefied composition containing 5 weight percent of sodium oleate. The fourth part of the hide was treated with the liquefied composition containing 10 weight percent of sodium oleate. The four treated pieces of hide were kept in a room at room temperature.

The hair was easily pulled out of the control piece of hide in 24 to 36 hours after the experiment started. The flesh of the control piece of hide deteriorated (became putrefied with a strong odor of putrefaction) after 2 days. The piece of hide treated with the liquefied composition containing 10 weight percent of sodium oleate was only about the same as the control. That is, the hair was easily pulled out after 24 to 36 hours and the (fourth) piece of hide putrefied after about 2 days. The second piece of hide (treated with the liquefied composition containing 2.5 weight percent of sodium oleate) had the following results: the hair was easily pulled out after 48 to 72 hours; and the piece of hide putrefied after about 3 days. With the third piece of hide (treated with the liquefied composition containing 5 weight percent of sodium oleate), the hair was still intact in the hide at the end of the sixth day, ¾ths of the hair was intact at the end of the seventh day and the hide did not putrefy until after the seventh day. Based on this data, the range of 3.5 to 9 weight percent of sodium oleate was chosen. Early in the test the hide thickness (hair, etc.) of about ½ inch had diminished substantially for all but the 5 percent-treated piece of hide.

Broadly this invention involves a process for the prevention and/or retardation of the spoilage of skins, hides, or pelts of animals. The process comprises treating a skin, hide or pelt with an effective amount of a liquefied composition consisting essentially of an effective amount of a non-necrotic sclerosing fatty acid salt, an effective amount of ethyl alcohol, a buffering agent and a water carrier. The fatty acid salt is one which has been prepared from an unsaturated fatty acid having one double bond and from a alkali metal or an alkaline earth metal or an alkali metal compound or an alkaline earth metal compound. The liquefied composition has a pH between 9 and 11.

What is claimed is:

1. Process for the prevention and/or retardation of the putrefaction of skins, hides, or pelts of animals which comprises treating a skin, hide or pelt from a freshly slaughtered animal, which has not yet been tanned or tawed, with a liquefied composition consisting essentially of a non-necrotic sclerosing fatty acid salt, ethyl alcohol, a buffering agent and a water carrier, said salt being prepared from an unsaturated fatty acid having at least one double bond and from an alkali metal or an alkaline earth metal or an alkali metal compound or an alkaline earth metal compound, and said liquefied composition having a pH between 9 and 11.

2. The process as claimed in claim 1 wherein said unsaturated fatty acid has one double bond.

3. Process as claimed in claim 2 wherein the pH of said liquefied composition is between 9.5 and 10.5.

4. The process as claimed in claim 2 wherein said fatty acid compound is sodium oleate.

5. The process as claimed in claim 2 wherein the buffering agent is disodium phosphate.

6. The process as claimed in claim 2 wherein the liquefied composition contains 2 to 7.5 percent of ethanol.

7. The process as claimed in claim 2 wherein the pH is about 9.8.

8. The process as claimed in claim 2 wherein the liquefied composition contains 3.5 to 9 percent of the fatty acid salt.

9. The process as claimed in claim 8 wherein a thickner is present in the liquefied composition.

10. The process as claimed in claim 2 wherein said fatty acid salt contains 14 to 22 carbon atoms.

11. The process as claimed in claim 2 wherein the fatty acid salt in the liquefied composition is calcium oleate.

12. The process as claimed in claim 2 wherein the fatty acid in the liquefied composition is potassium oleate.

13. The process as claimed in claim 2 wherein the buffering agent is sodium dihydrogen phosphate.

14. The process as claimed in claim 2 wherein the liquefied composition contains 0.1 to 5 percent ethanol.

15. The process as claimed in claim 2 wherein the liquefied composition is comprised of sodium oleate, water, ethanol, flavorant, sweetner and sodium dihydrogen phosphate.

16. The process as claimed in claim 2 wherein the liquefied composition contains about 5 percent of sodium oleate, about 5 percent of ethanol, enough disodium phosphate to adjust the pH to about 9.8 and the remainder water.

17. The process as claimed in claim 2 wherein the treatment step is repeated.

18. The process as claimed in claim 1 wherein the treated skin, treated hide or treated pelt is then tanned or tawed.

19. A treated hide, skin or pelt of a freshly slaughtered animal which has been treated by the process of claim 2.

* * * * *